US010758068B2

(12) United States Patent
Suh

(10) Patent No.: US 10,758,068 B2
(45) Date of Patent: Sep. 1, 2020

(54) HEATING BLANKET FOR MOTORIZED WHEELCHAIR

(71) Applicant: Dongha Suh, Gyeonggi-do (KR)

(72) Inventor: Dongha Suh, Gyeonggi-do (KR)

( * ) Notice: Subject to any disclaimer, the term of this patent is extended or adjusted under 35 U.S.C. 154(b) by 330 days.

(21) Appl. No.: 15/573,951

(22) PCT Filed: Jul. 17, 2015

(86) PCT No.: PCT/KR2015/007473
§ 371 (c)(1),
(2) Date: Nov. 14, 2017

(87) PCT Pub. No.: WO2016/182123
PCT Pub. Date: Nov. 17, 2016

(65) Prior Publication Data

US 2018/0289180 A1 Oct. 11, 2018

(30) Foreign Application Priority Data

May 14, 2015 (KR) ..... 10-2015-0067686

(51) Int. Cl.
*A47G 9/02* (2006.01)
*A47G 9/04* (2006.01)
(Continued)

(52) U.S. Cl.
CPC ..... *A47G 9/0215* (2013.01); *A47G 9/04* (2013.01); *A47G 9/066* (2013.01); *A61G 5/10* (2013.01);
(Continued)

(58) Field of Classification Search
CPC ..... A47G 9/0215; A47G 9/04; A47G 9/066; A47G 9/068; A47G 9/00; A47G 9/0223;
(Continued)

(56) References Cited

U.S. PATENT DOCUMENTS 5,148,002 A * 9/1992 Kuo ..... H01Q 1/273 219/211
7,816,628 B2 * 10/2010 Fernandez ..... A41D 13/0051 219/200
8,648,280 B1 * 2/2014 DeWitt ..... A47C 21/048 219/212
2007/0045269 A1 * 3/2007 Vassallo ..... H05B 3/342 219/211
(Continued)

FOREIGN PATENT DOCUMENTS

KR 2019920000226 1/1992
KR 2004331920000 12/2006
(Continued)

*Primary Examiner* — Frederick C Nicolas
(74) *Attorney, Agent, or Firm* — IPLA P.A.; James E. Bame

(57) ABSTRACT

A heating blanket for a motorized wheelchair includes: a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated.

4 Claims, 19 Drawing Sheets

(51) Int. Cl.

| | |
|---|---|
| ***A61G 5/10*** | (2006.01) |
| ***H05B 3/34*** | (2006.01) |
| ***H05B 3/04*** | (2006.01) |
| ***A47G 9/06*** | (2006.01) |

(52) U.S. Cl.
CPC ..... *H05B 3/04* (2013.01); *H05B 3/34* (2013.01); *A47G 9/0223* (2013.01); *A47G 2200/04* (2013.01); *H05B 3/347* (2013.01)

(58) Field of Classification Search
CPC .. A47G 9/023; A47G 9/1036; A47G 2200/04; H05B 3/04; H05B 3/34; H05B 3/342; H05B 3/345; H05B 3/347; A61G 5/1043; A61G 5/1045; A61G 5/1048; A61G 5/1091; A61G 5/10
See application file for complete search history.

(56) References Cited

U.S. PATENT DOCUMENTS

| | | | | |
|---|---|---|---|---|
| 2008/0093356 | A1* | 4/2008 | Pizzi | H05B 3/34 219/474 |
| 2009/0093354 | A1* | 4/2009 | Johnson | B65B 43/265 493/52 |
| 2009/0165206 | A1* | 7/2009 | Davis | A47D 15/006 5/494 |
| 2009/0216305 | A1* | 8/2009 | Bonner | A41D 13/1254 607/108 |
| 2015/0272236 | A1* | 10/2015 | Chen | A41D 13/0051 219/211 |
| 2016/0192792 | A1* | 7/2016 | Townsend | A41D 13/0012 5/484 |

FOREIGN PATENT DOCUMENTS

| | | |
|---|---|---|
| KR | 1020070074424 | 7/2007 |
| KR | 1020110053865 | 5/2011 |
| KR | 1020110075778 | 7/2011 |

* cited by examiner

HEATING BLANKET FOR MOTORIZED WHEELCHAIR

BACKGROUND

The present invention relates to a heating blanket for a motorized wheelchair in which a heating plate is detachably mounted to the inside of a blanket, a battery is installed at the motorized wheelchair, and a controller is installed at the front pocket of the blanket to connect the battery with the heating plate, thereby supplying power to the heating plate. In a state that a user sits on the motorized wheelchair or a motorized scooter, he or she can easily control the operation of the heating plate installed at a desired position.

BACKGROUND ART

A motorized wheelchair is a convenient means of transport and so many old and the infirm, and the disabled people use it. Also, in the winter, it becomes a useful means of transport. Especially, when using the motorized wheelchair in the winter, a thermal blanket is needed.

As a prior art of this field, according to Korean Patent Publication No. 2011-0075778 (Title of the Invention: blanket for wheelchair with an embedded heating device), it relates to a heating blanket for a person for using a wheelchair. At the cold weather with low temperature, it is a portable heating device for the old and the infirm, and the disabled people. Also, the prior art discloses a thermal blanket with a rechargeable portable battery to provide the warmth anytime or anywhere.

In the above technique, the blanket has a type that it is usable at a wheelchair. An insulator for preventing the heat loss is attached to the outside of the blanket, a heating body is arranged between the insulator and the blanket, and a smooth cloth is attached to the inside of the blanket. The thermal energy is produced by supplying energy to the blanket through the rechargeable portable battery and so the warmth is generated. The blanket comprises a battery coupling terminal and a heating plate, and a folding device for preventing the wind. A battery storage space is formed at the inside of a heating blanket. An open/close device is mounted to the outer surface of the blanket at the back of the insulator. As the result, the blanket can easily possess the battery through the storage space.

However, in the above heating blanket, although a face heating element or a heating line is embedded with the blanket, change of its position is impossible and the control of temperature is not easy. Especially, since a function for increasing the temperature at tiptoe or a specific portion is impossible, it is inconvenient to users.

SUMMARY OF THE INVENTION

In consideration of the above-described problems of the prior art, it is an object of the present invention to provide a heating blanket for a motorized wheelchair in which power from a battery mounted to the motorized wheelchair is supplied to a heating plate detachably mounted to the inside of a blanket, thereby generating heat.

It is another object of the present invention to provide a heating blanket for a motorized wheelchair in which a controller is installed at the front pocket of the blanket to connect the battery with the heating plate, and in a state that a user sits on the motorized wheelchair or a motorized scooter, he or she can easily control the operation of the heating plate installed at a desired position.

In order to accomplish the above objects, according to an aspect of the present invention, there is provided a heating blanket for a motorized wheelchair comprising: a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back windproof and waterproof fabric via the zipped entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated by receiving power from a power supply unit of the motorized wheelchair, wherein the front side of the windproof and waterproof fabric is provided with an upper pocket part which covers the zipped entrance/exit and of which both the upper side and the lower side, except for a hand entrance/exit slot, are sewn, wherein the electric wire and the connection part are positioned inside the windproof and waterproof fabric together with the at least one heating plate, wherein the connection jack is connected to the motorized wheelchair and to a battery of the motorized wheelchair, and is positioned inside the upper pocket part together with the battery, wherein the adjustment part is positioned inside or outside the upper pocket part to allow manipulation inside the upper pocket part, and wherein the lower back end side of the windproof and waterproof fabric is provided with a pocket part for covering feet.

As described above, according to a heating blanket for a motorized wheelchair according to the present invention, a heating plate is detachably mounted to the inside of a blanket, a battery is installed at the motorized wheelchair, and a controller is installed at the front pocket of the blanket to connect the battery with the heating plate, thereby supplying power to the heating plate. In a state that a user sits on the motorized wheelchair or a motorized scooter, he or she can easily control the operation of the heating plate installed at a desired position.

Also, in the heating blanket for a motorized wheelchair according to the present invention, a space for receiving the feet of a user is equipped with a lower backside of the blanket and so after seating a user on the motorized wheelchair, the user's feet are easily covered on the move, the thermal effect of the feet is provided, the feeling of fatigue is reduced, and blood-flow disorders can be prevented.

DETAILED DESCRIPTION OF THE INVENTION

Figure 1:
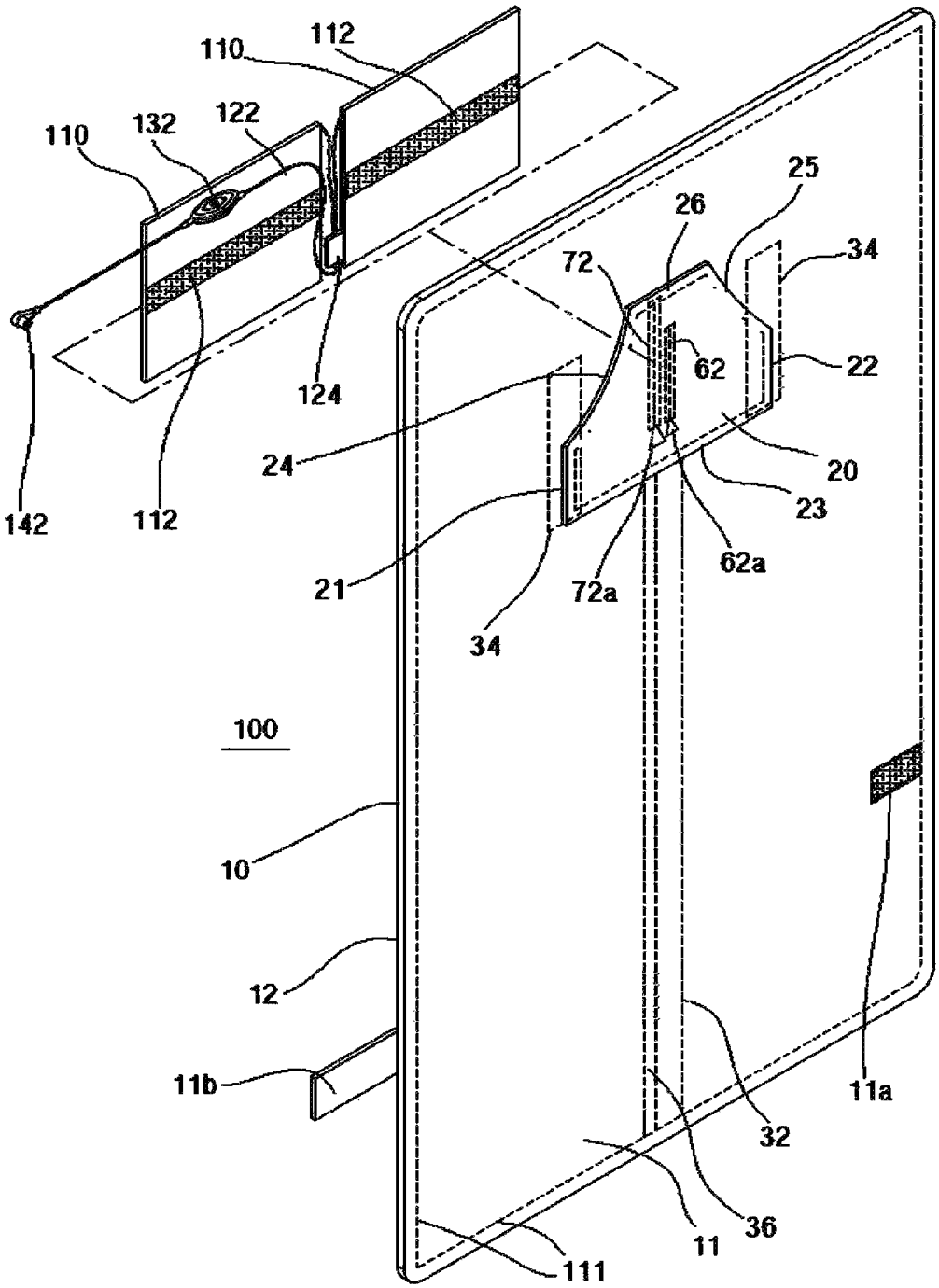
FIG. 1 is a front exploded perspective view of a heating blanket for a motorized wheelchair according to the present invention.

In order to accomplish the above objects, according to an aspect of the present invention, there is provided a heating blanket for a motorized wheelchair comprising: a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated by receiving power from a power supply unit of the motorized wheelchair, wherein the front side of the windproof and waterproof fabric is provided with an upper pocket part which covers the zipped entrance/exit and of which both the upper side and the lower side, except for a hand entrance/exit slot, are sewn, wherein the electric wire and the connection part are positioned at the inside of the windproof and waterproof fabric together with the heating plates, wherein the connection jack is connected with a battery of the motorized wheelchair and located at the upper pocket part together with the battery, and the controller also is located at the inside or outside of the upper pocket part, so that it can be easily operated at the inside or outside of the upper pocket part, and wherein upper pocket parts for covering feet are formed at the lower back side of the windproof and waterproof fabric.

Preferably, the heating blanket for a motorized wheelchair according to claim 1, wherein a luminous band is added to the front side of the windproof and waterproof fabric.

According to another aspect of the present invention, there is provided a heating blanket for a motorized wheelchair comprising: a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated by receiving power from a power supply unit of the motorized wheelchair, wherein the front side of the windproof and waterproof fabric is provided with an upper pocket part which covers the zipped entrance/exit and of which both the upper side and the lower side, except for a hand entrance/exit slot, are sewn, wherein the electric wire and the connection part are positioned at the inside of the windproof and waterproof fabric together with the heating plates, wherein the connection jack is connected with a battery of the motorized wheelchair and located at the upper pocket part together with the battery, and the controller also is located at the inside or outside of the upper pocket part, so that it can be easily operated at the inside or outside of the upper pocket part, wherein the windproof and waterproof fabric comprises an upper fabric having the upper pocket part and a lower fabric in which zipper parts are attached to both sides thereof and combined by a zipper, and wherein when the zipper parts are combined, the plane shape of the windproof and waterproof fabric has a "T"-shaped fabric.

According to another aspect of the present invention, there is provided a heating blanket for a motorized wheelchair comprising: a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated by receiving power from a power supply unit of the motorized wheelchair, wherein the front side of the windproof and waterproof fabric is provided with an upper pocket part which covers the zipped entrance/exit and of which both the upper side and the lower side, except for a hand entrance/exit slot, are sewn, wherein the electric wire and the connection part are positioned at the inside of the windproof and waterproof fabric together with the heating plates, wherein the connection jack is connected with a battery of the motorized wheelchair and located at the upper pocket part together with the battery. The controller also is located at the inside or outside of the upper pocket part, so that it can be easily operated at the inside or outside of the upper pocket part, wherein the windproof and waterproof fabric comprises a front fabric having the upper pocket part, a bottom fabric in which it is connected with a partial lower part of the front fabric to form a bottom, and a back side fabric in which it is connected with the back side of the front fabric and the bottom fabric to form a space, and wherein zipper parts are formed at the lower side and a partial bottom side of the front fabric, a zipper part is formed at a side of the bottom fabric corresponding to the zipper part of the front fabric, and zipper parts are formed at a side of the back side fabric corresponding to the zipper part of the front fabric, ss a result, the zipper parts are combined by a zipper part and so a back side space is formed through the front fabric, the back side fabric, and the bottom fabric.

According to another aspect of the present invention, there is provided a heating blanket for a motorized wheelchair comprising: a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated by receiving power from a power supply unit of the motorized wheelchair, wherein the front side of the windproof and waterproof fabric is provided with an upper pocket part which covers the zipped entrance/exit and of which both the upper side and the lower side, except for a hand entrance/exit slot, are sewn, wherein the electric wire and the connection part are positioned at the inside of the windproof and waterproof fabric together with the heating plates, wherein the connection jack is connected with a battery of the motorized wheelchair and located at the upper pocket part together with the battery, and the controller also is located at the inside or outside of the upper pocket part, so that it can be easily operated at the inside or outside of the upper pocket part, wherein a protection part is extended and formed at the lower middle end of the windproof and waterproof fabric, wherein a pair of lower body windproof and waterproof fabrics cover a thermal lining having Velcro fasteners attached to at least one position thereof, has windproof and waterproof functions, and has a zipper and a zipped entrance/exit formed on the front and back sides thereof, wherein the lower body windproof and waterproof fabrics are characterized in that at least one heating plate which is inserted into a back side windproof and waterproof fabric via the zipper entrance/exits is detachably mounted on the thermal lining, wherein the heating plate is woven with carbon yarns so that the heating plate generates heat when electricity is applied, wherein the lower body windproof and waterproof fabrics are folded and then used, and zipper parts are formed at the parts corresponding to the folded parts and also the lower body windproof and waterproof fabrics are combined and separated by zippers, and wherein the lower body windproof and waterproof fabrics are combined with the wind proof and waterproof fabric by Velcro fasteners and after combining, the protection part of the windproof and waterproof fabric is positioned at the middle portion of the lower body windproof and waterproof fabrics.

Preferably, a pair of left and right arm straps or shoulder hooking straps are equipped with the upper side of the windproof and waterproof fabric.

Hereinafter, embodiments according to the present invention will be described in detail with reference to the accompanying drawings. The embodiments are preferred embodiments of the present invention and do not limit the scopes of claims. This invention has been described in its presently contemplated best mode, and it is clear that it is susceptible to numerous modifications, modes and embodiments within the ability of those skilled in the art and without the exercise of the inventive faculty.

Figure 2:
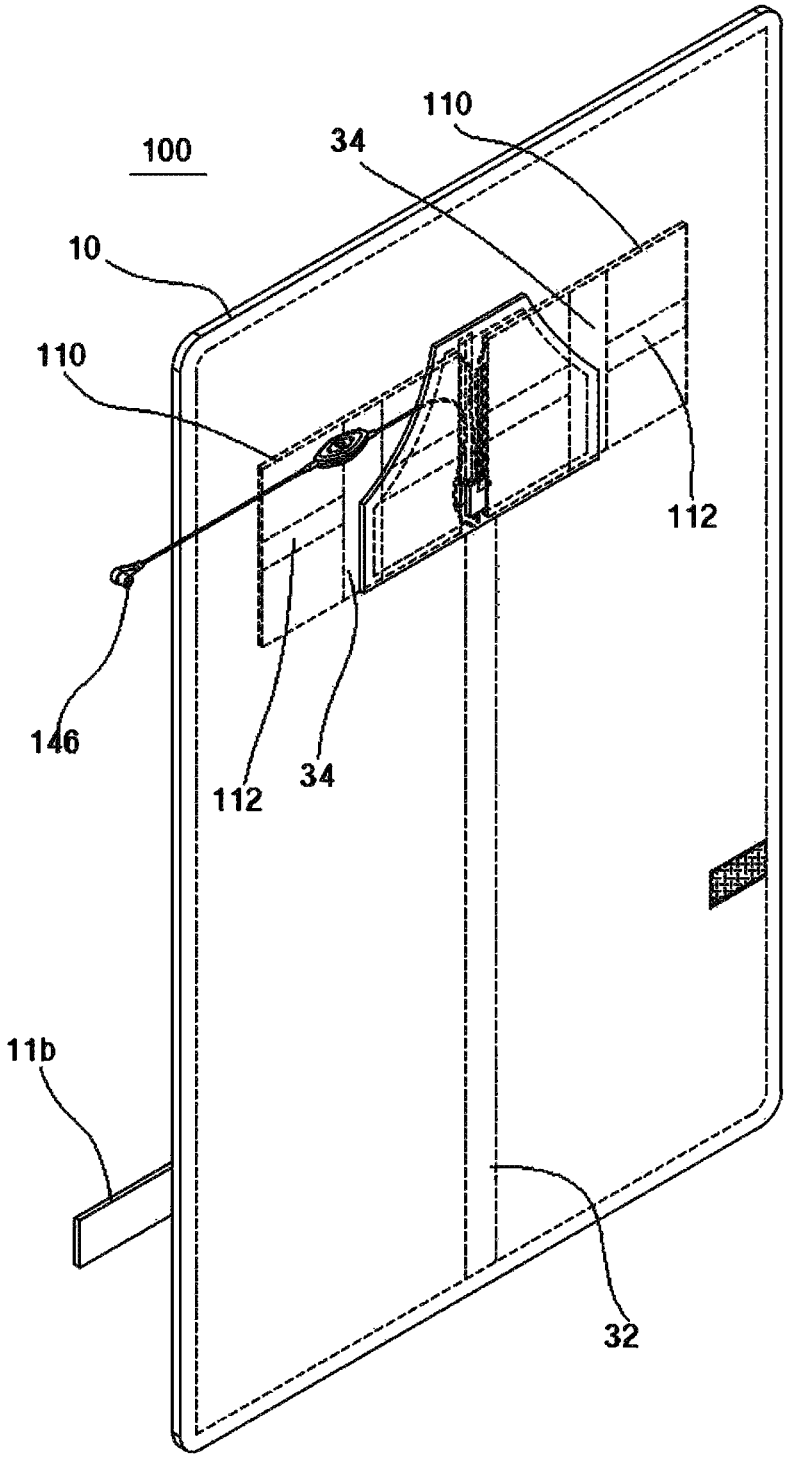
FIG. 2 is a front combined perspective view of FIG. 1.
Figure 3:
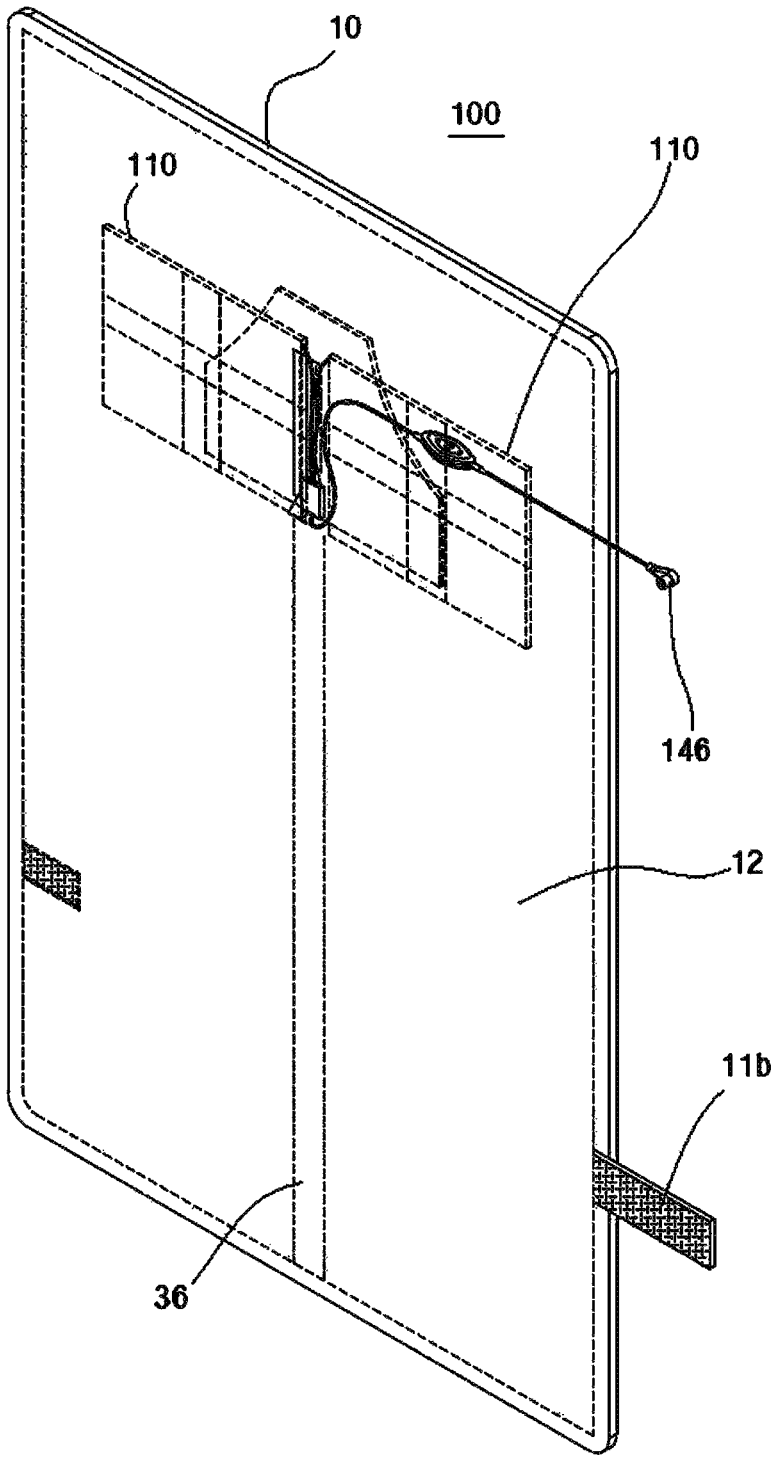
FIG. 3 is a back combined perspective view of a heating blanket for a motorized wheelchair according to the present invention.
Figure 4:
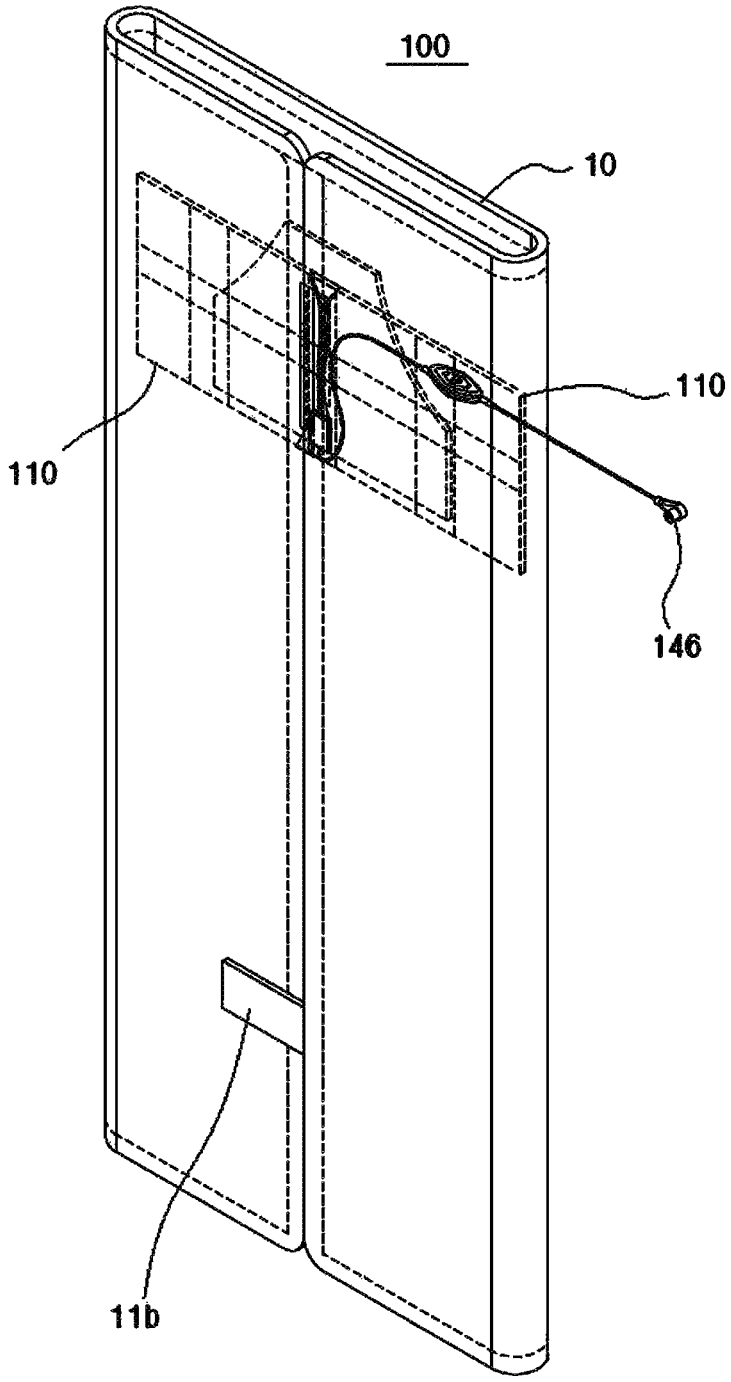
FIG. 4 is a perspective view of a back folded state of a heating blanket for a motorized wheelchair according to the present invention.
Figure 5:
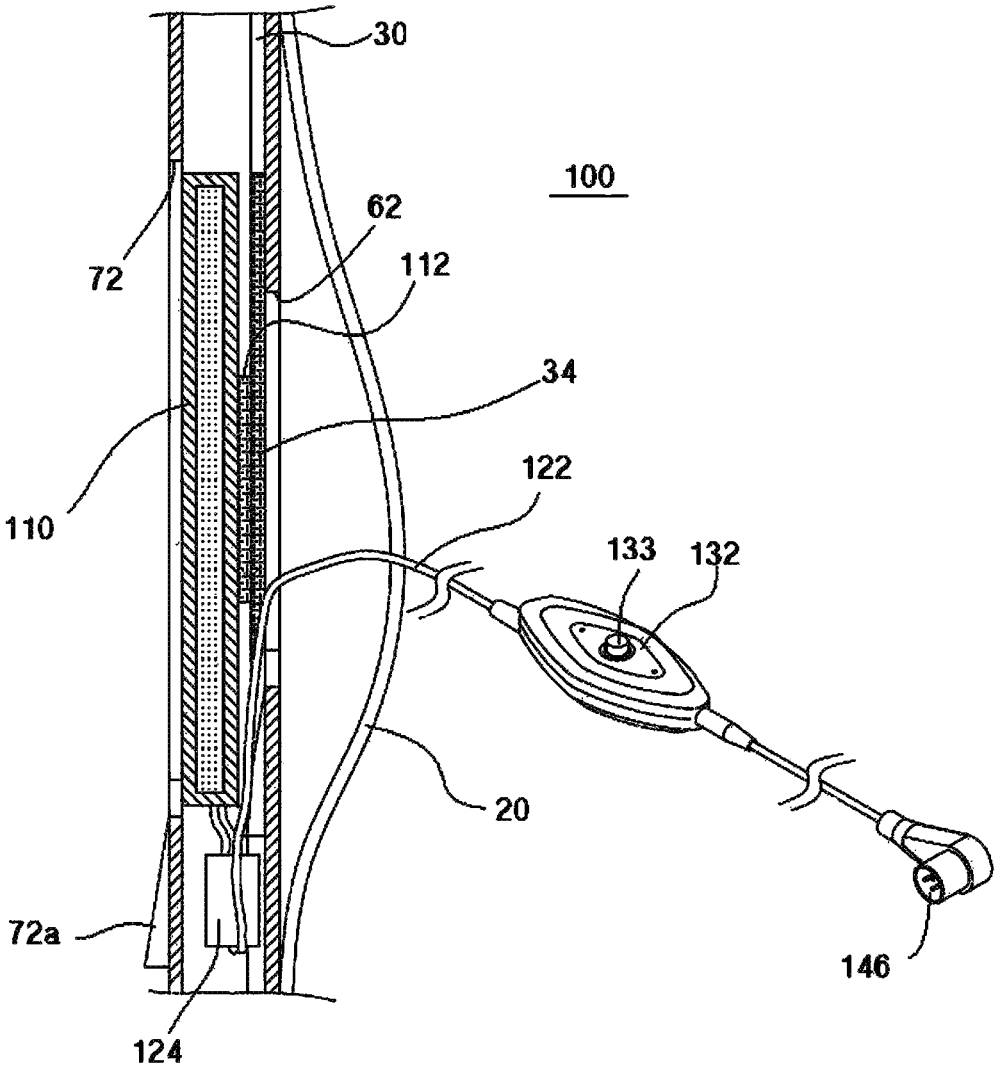
FIG. 5 is an enlarged cross-sectional view of a part of a heating blanket for a motorized wheelchair according to the present invention.
Figure 6:
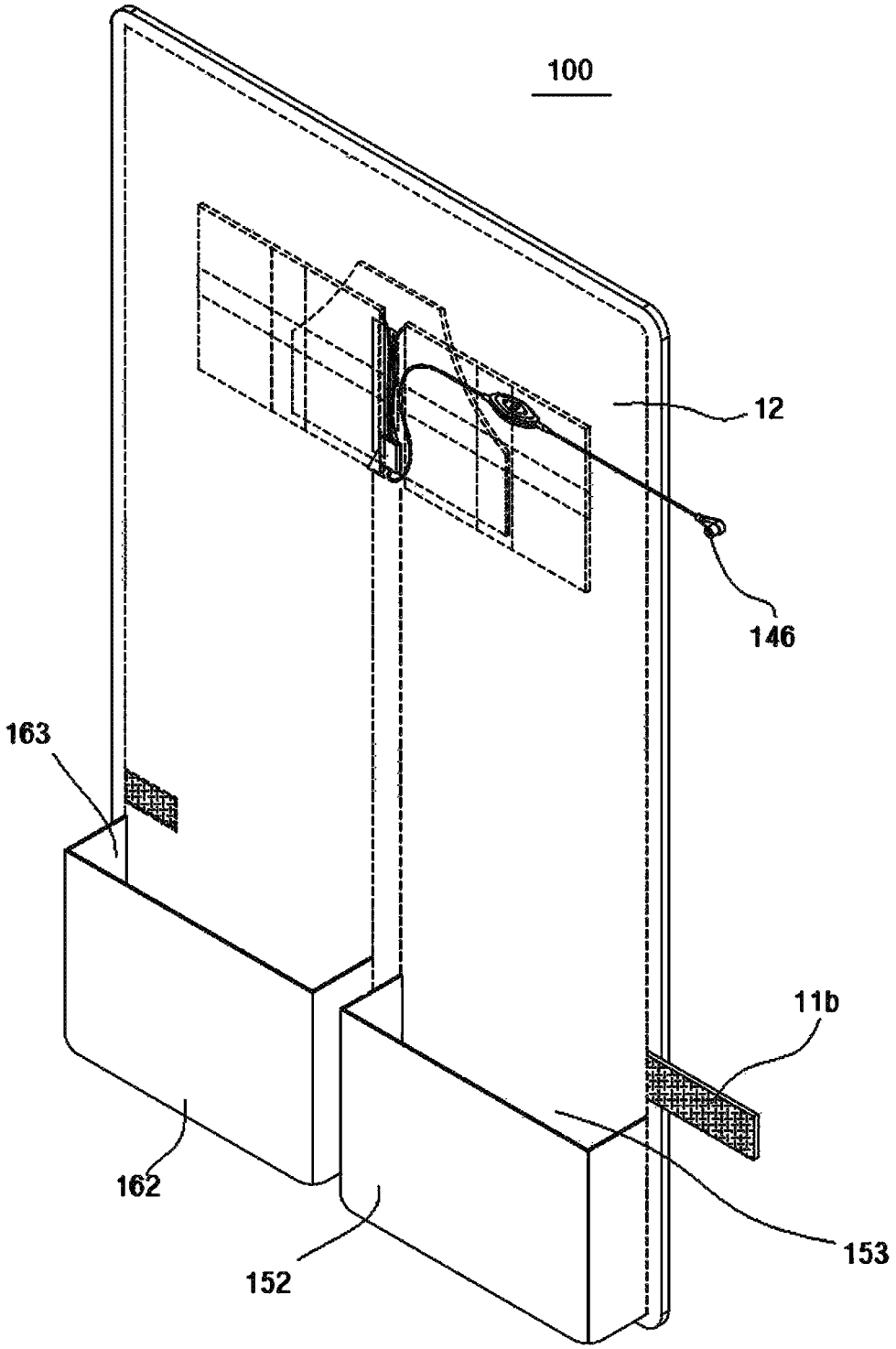
FIG. 6 is a perspective view of another embodiment of a heating blanket for a motorized wheelchair according to the present invention.
Figure 7:
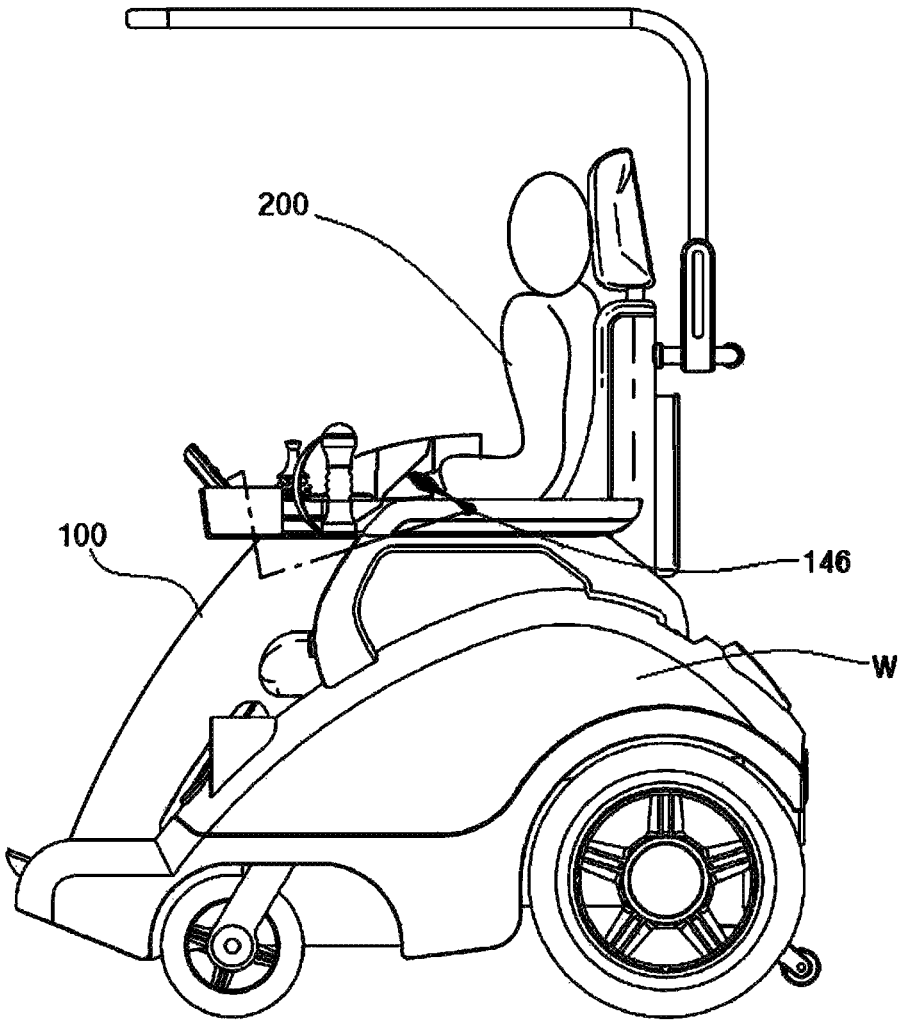
FIG. 7 is a use state view of a heating blanket for a motorized wheelchair according to the present invention.

FIG. 1 is a front exploded perspective view of a heating blanket for a motorized wheelchair according to the present invention. FIG. 2 is a front combined perspective view of FIG. 1. FIG. 3 is a back combined perspective view of a heating blanket for a motorized wheelchair according to the present invention. FIG. 4 is a perspective view of a back folded state of a heating blanket for a motorized wheelchair according to the present invention. FIG. 5 is an enlarged cross-sectional view of a part of a heating blanket for a motorized wheelchair according to the present invention. FIG. 6 is a perspective view of another embodiment of a heating blanket for a motorized wheelchair according to the present invention. FIG. 7 is a use state view of a heating blanket for a motorized wheelchair according to the present invention.

As shown in FIGS. 1 to 6, according to a heating blanket for a motorized wheelchair 100 comprises a windproof and waterproof fabric 10 which covers a thermal lining having Velcro fasteners 34 attached to at least one position thereof, has windproof and waterproof functions, and has a zipper 62*a* and 72*a* and a zipped entrance/exit 62 and 72 formed on the front and back sides thereof; at least one heating plate 110 which is inserted into a back side (polarpolis fabric) windproof and waterproof fabric 10 via the zipper 72*a* and is detachably mounted on the thermal lining 30, wherein the heating plate is woven with carbon yarns so that the heating plate generates heat when electricity is applied; an electric wire 122, a connection part 124, an adjustment part 132, and a connection jack 146 for supplying electricity to the heat plate, wherein the heating blanket is characterized in that the connection jack 146 is connected to the outside to allow the heating plate to be heated by receiving power of 24V from a power supply unit of the motorized wheelchair, wherein the front side of the windproof and waterproof fabric is provided with an upper pocket part 20 which covers the zipped entrance/exit 62 and of which both the upper side and the lower side, except for a hand entrance/exit slot 24 and 25, are sewn.

A luminous band 32 is added to the front side of the windproof and waterproof fabric 10.

Male and Female Velcro fasteners 11*a* and 11*b* are mounted to the front side of the windproof and waterproof fabric 10 and then after wearing it, both sides thereof are mutually fixed with each other.

The connection jack 146 is connected with a power supply unit mounted to the motorized wheelchair W and so the heating plate 110 is heated by receiving the power.

At the lower back end side 12 of the windproof and waterproof fabric 10 is provided with at least one or more pocket parts 153 and 163 for covering feet.

One or more upper pocket parts 20 can be mounted to proper positions.

In FIG. 1, the size and position of the zipper 72*a* and the zipper entrance/exit 72 can be changed more bigger and so can be modified according to the size of the heating plate 110.

As shown in FIG. 5, the heating plate 110 is combined with a Velcro fastener 34 located at a constant position of the thermal lining 30 through a Velcro fastener 112. The thermal lining 30 can be formed by a fabric with a Velcro material. The thermal lining 30 is sewn by forming a sewing part 111 at the circumferential part within the windproof and waterproof fabric 10.

According to the present invention as described above, when using a heating blanket for a motorized wheelchair 100, a user opens a zipper 72*a* of a back side 12 of the heating blanket 100, inserts the heating plate 110 through a zipper entrance/exit 72 and then attaches it to a desired position (for example, desired positions such as knee, calf, ankle and so on) of a thermal lining. A fabric with Velcro materials can be used originally as the thermal lining. Also, as shown in FIG. 1, two Velcro fasteners (fixing parts) 34 are installed at specific positions or one or more Velcro fasteners (fixing parts) 36 are installed at the position corresponding to the position on which a luminous band of the front windproof and waterproof fabric is installed, and then fixed with the Velcro 112 of the heating plate 110.

In case that there are two heating plate 110, they are operable by connecting them with each other. A user takes out a controller 132 of an end of an electric wire 122 which is connected by a connection part 124 and a connection jack 146 through a zipper 62*a* and a zipper entrance/exit 62 within an upper front side pocket part 20 of a polarpolis fabric 10. The user puts the controller 132 on the upper front side pocket part 20 and inserts his hand into the upper front side pocket part 20 and can operate the controller 132. Also, the user can take out the connection jack 146 (it can connect with a power supply part of a motorized wheelchair) to connect it to the power supply part (which refers to FIG. 7.)

On the other hand, as shown in FIG. 6, a user can use a heating blanket for a motorized wheelchair of a windproof and waterproof fabric to cover his desired position at the state that he or she sits on the motorized wheelchair. A user can cover his feet by folding a foot portion in the heating blanket and using Velcro fasteners 11*a* and 11*b*. Also, a user inserts his feet into pocket parts 153 and 163 positioned at the lower portions of the heating blanket 100 and so can obtain the thermal effect. Although two pocket parts are formed, a pocket part can be formed at the middle position of the heating blanket.

As described above, according to a heating blanket for a motorized wheelchair according to the present invention, a heating plate is detachably mounted to the inside of a blanket, a battery is installed at the motorized wheelchair, and a controller is installed at the front pocket of the blanket to connect the battery with the heating plate, thereby supplying power to the heating plate. In a state that a user sits on the motorized wheelchair or a motorized scooter, he or she can easily control the operation of the heating plate installed at a desired position.

Also, in the heating blanket for a motorized wheelchair according to the present invention, a space for receiving the feet of a user is equipped with a lower backside of the blanket and so after seating a user on the motorized wheelchair, the user's feet are easily covered on the move, the thermal effect of the feet is provided, the feeling of fatigue is reduced, and blood-flow disorders can be prevented.

The present invention can be applied identically to a motorized wheelchair and a motorized scooter.

In a windproof and waterproof fabric of the present invention, a front side thereof is a waterproof fabric and the back side thereof is a polarpolis fabric.

When making the inside of the windproof and waterproof fabric, that is, a portion at which a heating plate is installed, a material (Nyrex (trademark) fabric, or male Velcro fastener is spread thinly) that a Velcro fastener is unnecessary can be used and formed. In this case, a Velcro fastener (fixing member) installed at the heating plate is unnecessary, a user can attach the heating plate to the inside of the windproof an waterproof fabric.

Figure 8:
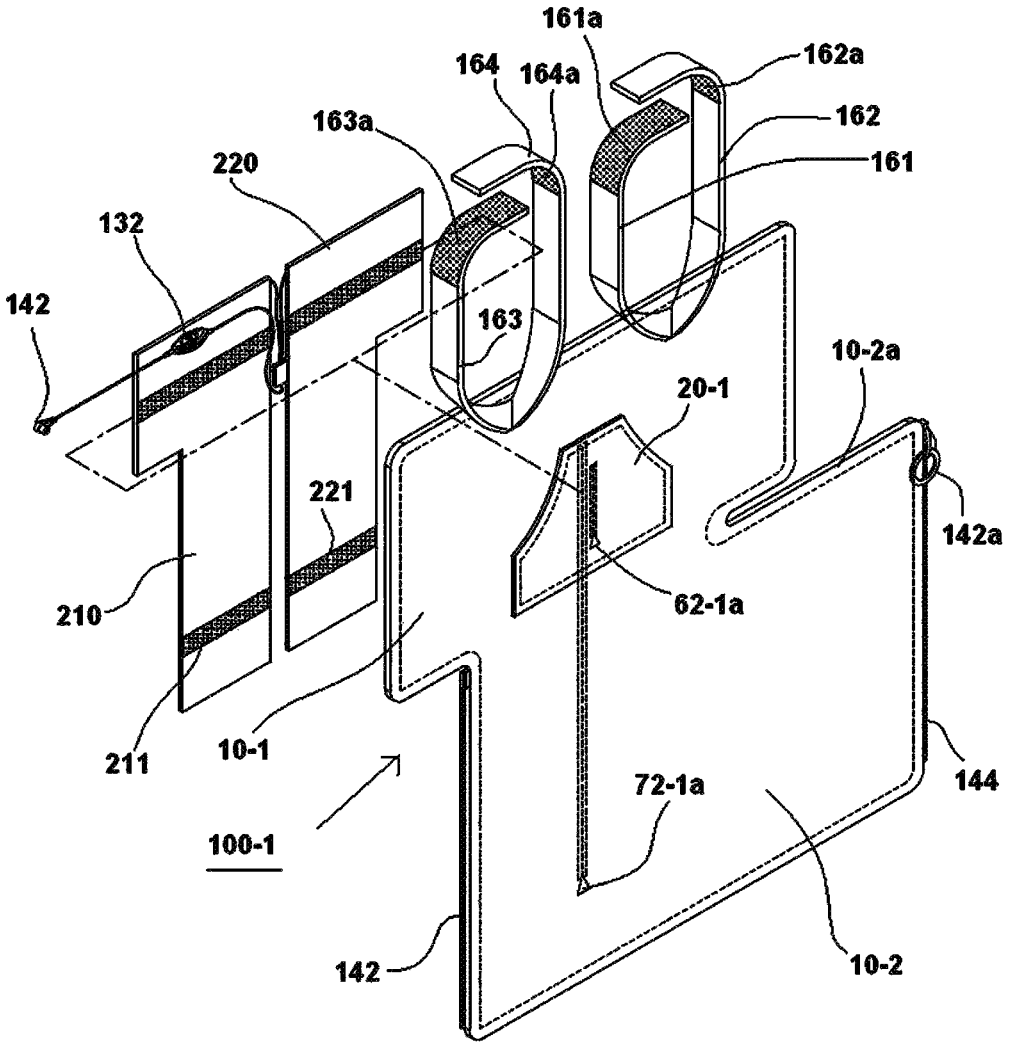
FIG. 8 is an exploded perspective view of another embodiment of a heating blanket for a motorized wheelchair according to the present invention.
Figure 9:
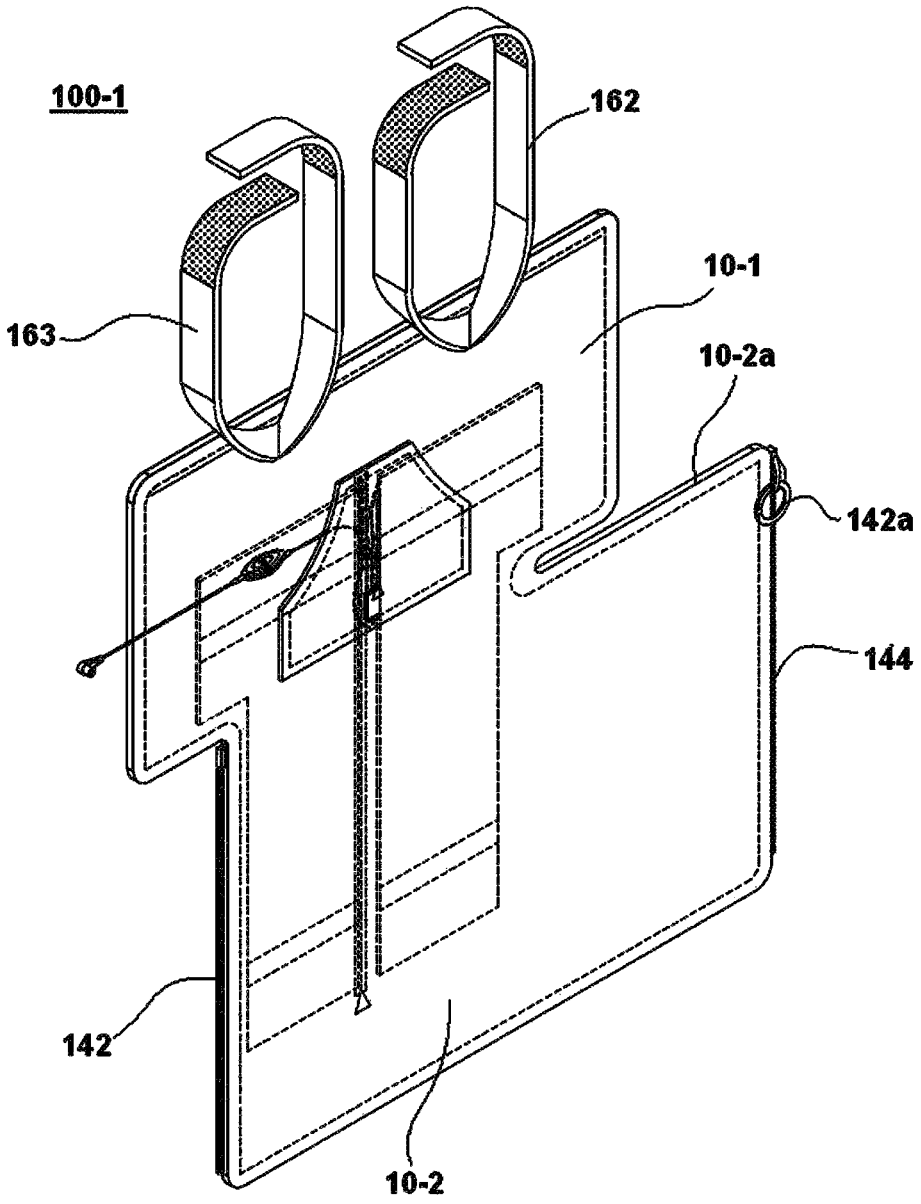
FIG. 9 is a combined perspective view of FIG. 8.
Figure 10:
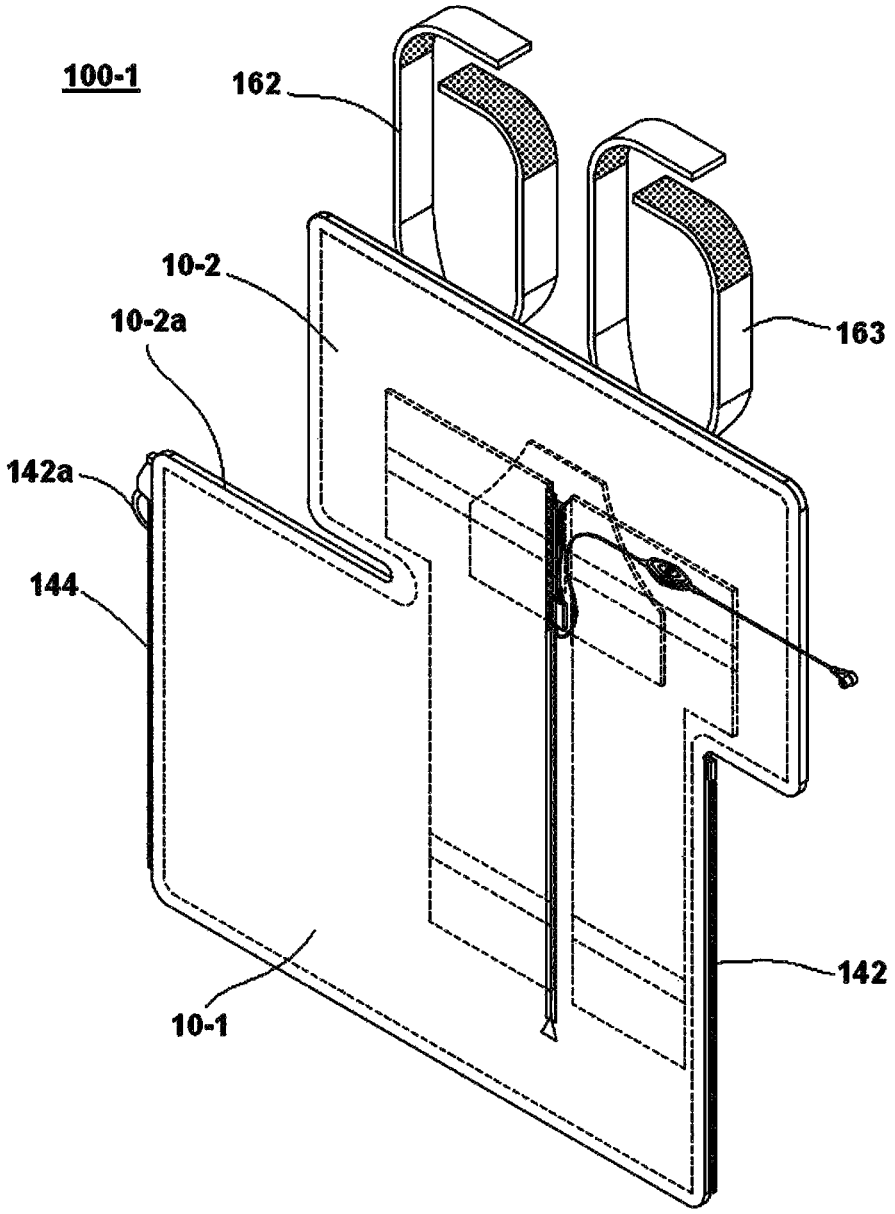
FIG. 10 is a perspective view illustrating a back side of FIG. 8.
Figure 11:
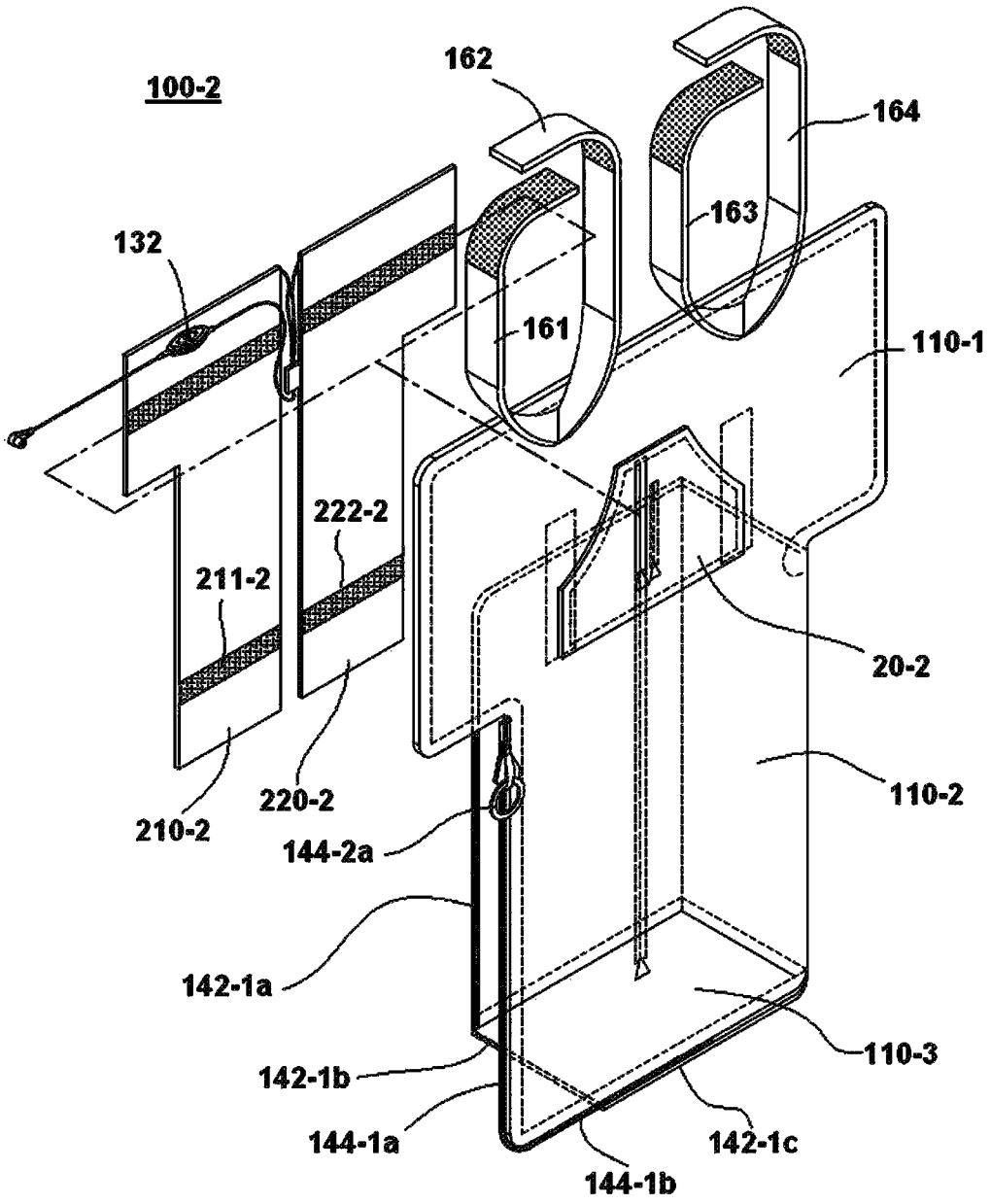
FIG. 11 is a perspective view illustrating a use state of FIG. 8.

FIG. 8 is an exploded perspective view of another embodiment of a heating blanket for a motorized wheelchair according to the present invention. FIG. 9 is a combined perspective view of FIG. 8. FIG. 10 is a perspective view illustrating a back side of FIG. 8. FIG. 11 is a perspective view illustrating a use state of FIG. 8.

As shown in FIGS. 8 to 11, according to a heating blanket for a motorized wheelchair 100-1 comprises a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated by receiving power from a power supply unit of the motorized wheelchair, wherein the front side of the windproof and waterproof fabric is provided with an upper pocket part 20-1 which covers the zipped entrance/exit and of which both the upper side and the lower side, except for a hand entrance/exit slot, are sewn.

The electric wire and the connection part are positioned at the inside of the windproof and waterproof fabric together with the heating plates 210 and 220.

The connection jack is connected with a battery of the motorized wheelchair and located at the upper pocket part together with the battery. The controller also is located at the inside or outside of the upper pocket part, so that it can be easily operated at the inside or outside of the upper pocket part.

The windproof and waterproof fabric comprises an upper fabric 10-1 having the upper pocket part and a lower fabric 10-2 in which zipper parts 142 and 144 are attached to both sides thereof and combined by a zipper 142*a*.

When the zipper parts are combined, the plane shape of the windproof and waterproof fabric has a "T"-shaped fabric.

As shown in FIG. 8, a reference numeral 10-2*a* denotes an extended part of the lower fabric to a side to the upper fabric 10-1. The lower fabric is before folding. As a result, when the lower fabric 10-2 is folded, the windproof and waterproof fabric becomes the "T"-shaped fabric. Also, as shown in FIG. 11, when the upper fabric 10-1 is folded, the windproof and waterproof fabric becomes a "straight line"-shaped fabric.

A pair of left and right arm straps or shoulder hooking straps 161, 162, 163, and 164 are equipped with the upper side of the upper fabric 10-1.

An operation of the heating blanket of the motorized wheelchair 100-1 with the above-construction is the same as the embodiment of FIG. 1 and so its detailed description will be omitted. The heating blanket of the motorized wheelchair 100-1 is characterized in that a lower body of a user can easily be covered through the zipper part.

Figure 12:
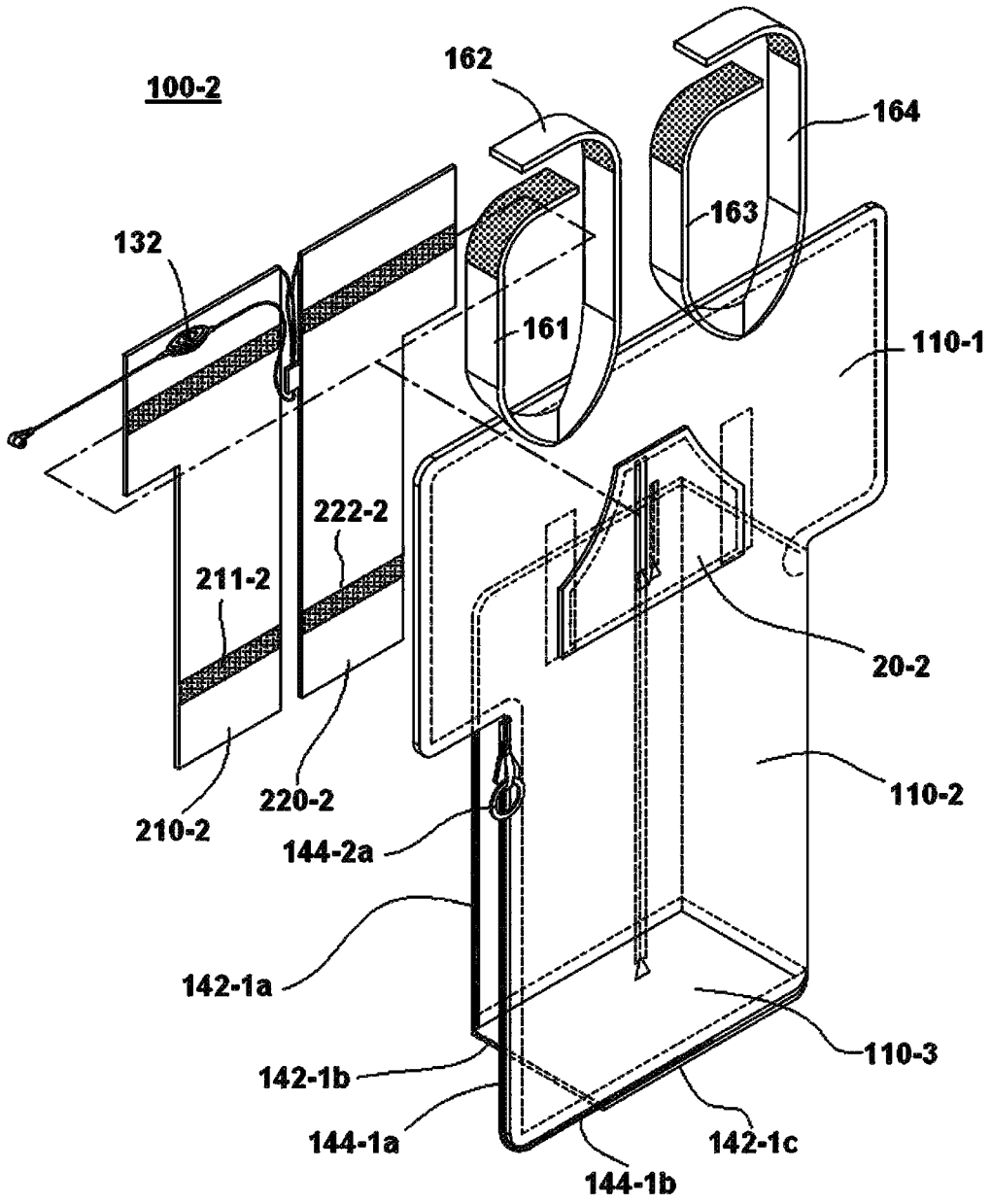
FIG. 12 is an exploded perspective view of another embodiment of a heating blanket for a motorized wheelchair according to the present invention.
Figure 13:
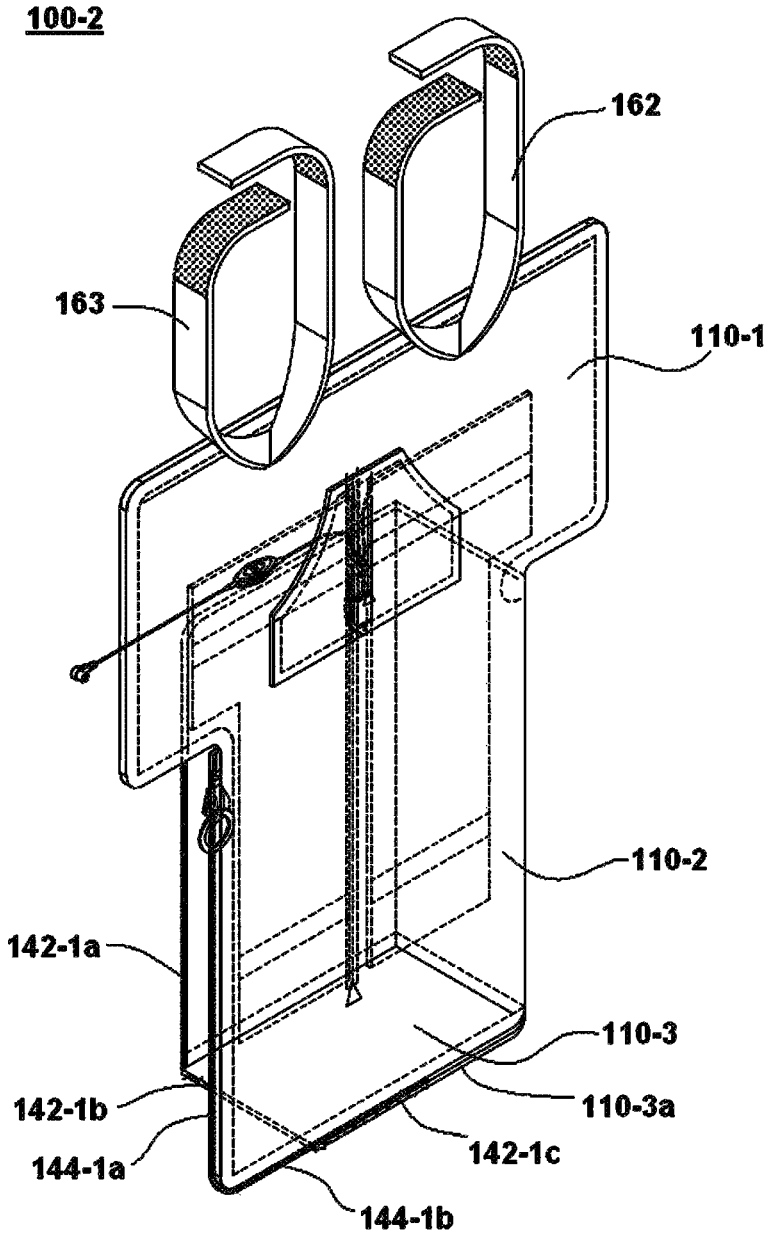
FIG. 13 is a combined perspective view of FIG. 12.
Figure 14:
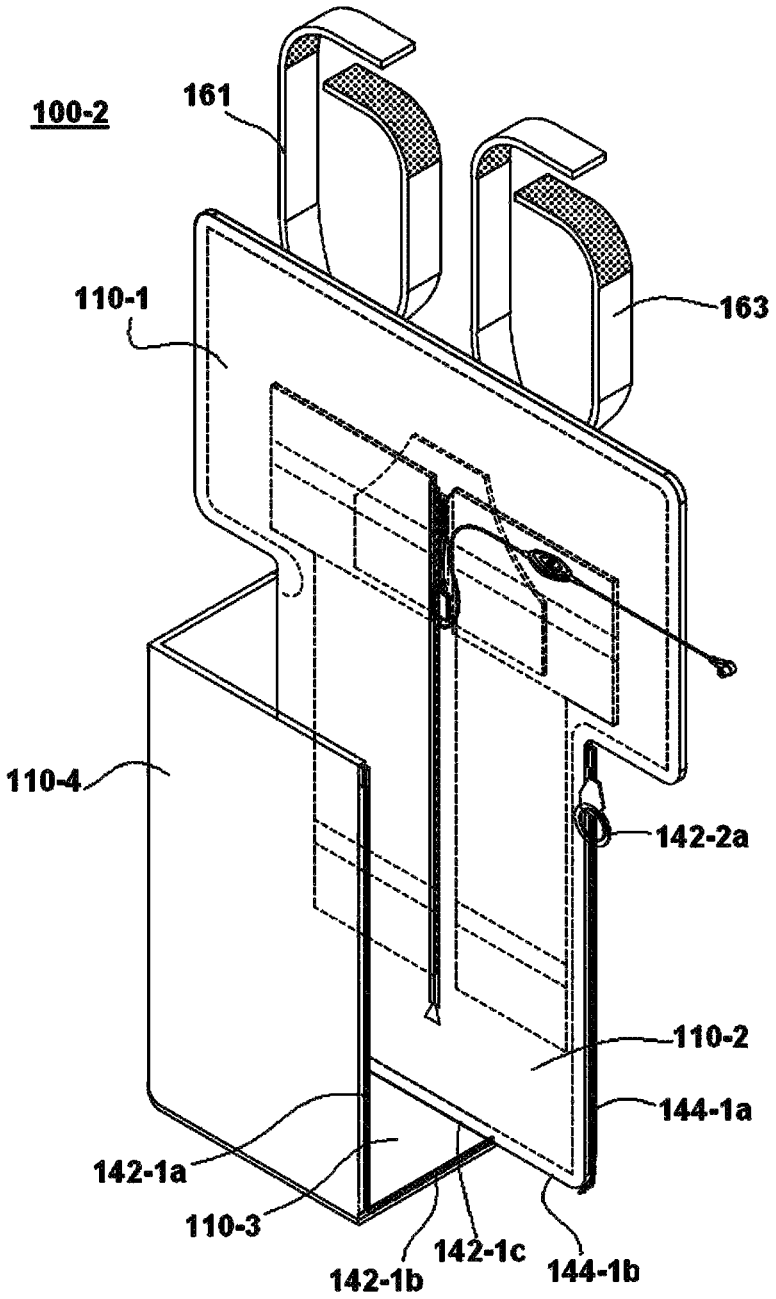
FIG. 14 is a perspective view of a back side of FIG. 12.
Figure 15:
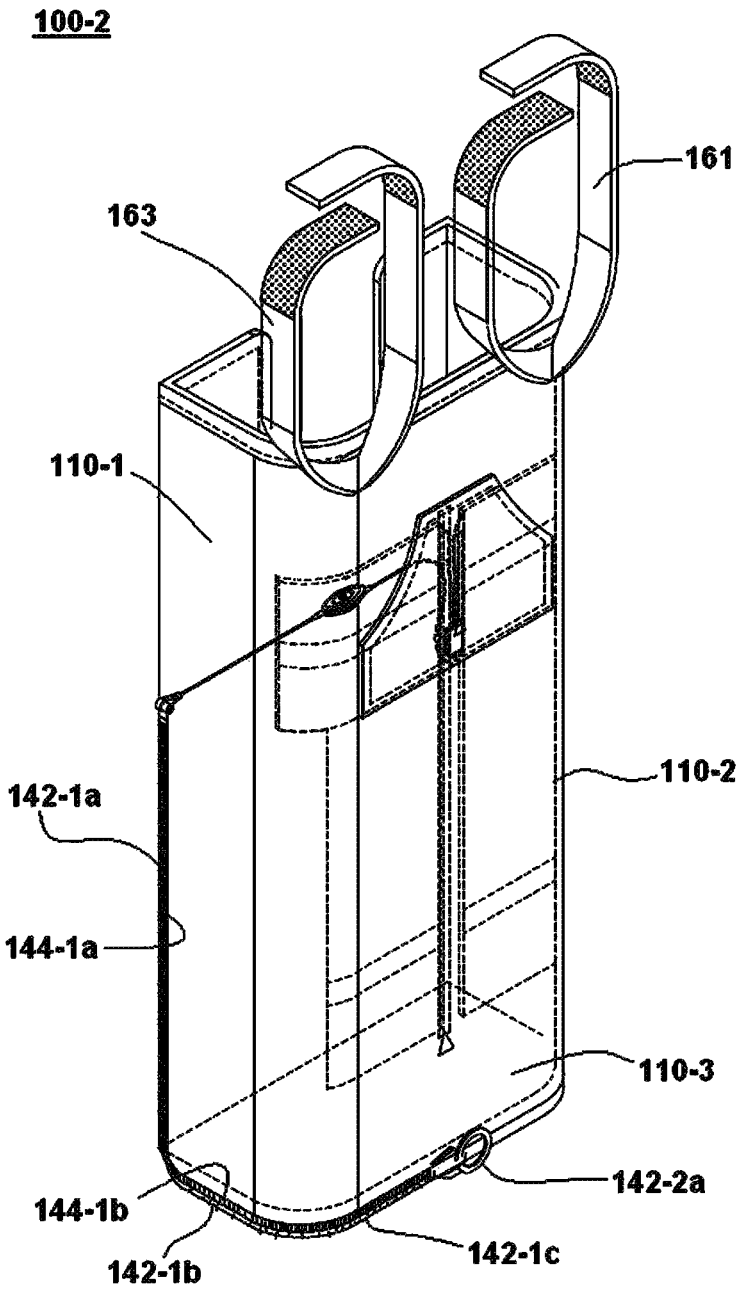
FIG. 15 is a perspective view of a use state of FIG. 12.

FIG. 12 is an exploded perspective view of another embodiment of a heating blanket for a motorized wheelchair according to the present invention. FIG. 13 is a combined perspective view of FIG. 12. FIG. 14 is a perspective view of a back side of FIG. 12. FIG. 15 is a perspective view of a use state of FIG. 12.

As shown in FIGS. 12 to 15, according to a heating blanket for a motorized wheelchair 100-2 comprises a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated by receiving power from a power supply unit of the motorized wheelchair, wherein the front side of the windproof and waterproof fabric is provided with an upper pocket part 20-2 which covers the zipped entrance/exit and of which both the upper side and the lower side, except for a hand entrance/exit slot, are sewn.

The electric wire and the connection part are positioned at the inside of the windproof and waterproof fabric together with the heating plates 210-2 and 220-2.

The connection jack is connected with a battery of the motorized wheelchair and located at the upper pocket part together with the battery. The controller also is located at the inside or outside of the upper pocket part, so that it can be easily operated at the inside or outside of the upper pocket part.

The windproof and waterproof fabric comprises a front fabric 110-1 having the upper pocket part, a bottom fabric 110-2 in which it is connected with a partial lower part of the front fabric to form a bottom, and a back side fabric 10-2 in which it is connected with the back side of the front fabric and the bottom fabric to form a space.

Zipper parts 144-1*a* and 144*b* are formed at the lower side and a partial bottom side of the front fabric, a zipper part 142-1*c* is formed at a side of the bottom fabric corresponding to the zipper part of the front fabric, and zipper parts 142-1*a* and 142-1*b* are formed at a side of the back side fabric corresponding to the zipper part of the front fabric. As a result, the zipper parts are combined by a zipper part 144-2*a* and so a back side space is formed through the front fabric, the back side fabric, and the bottom fabric.

A sliding (slip)-resistant fabric 110-3*a* are additionally combined with the bottom of the bottom fabric 110-3. By this, after wearing the heating blanket of the motorized wheelchair 100-2, when a user steps on a footboard of the wheelchair, the user do not slip on the footboard and so an occurrence of a negligent accident is prevented.

A pair of left and right arm straps or shoulder hooking straps 161, 162, 163, and 164 are equipped with the upper side of the front fabric 110-1.

An operation of the heating blanket of the motorized wheelchair 100-2 with the above-construction is the same as the embodiment of FIG. 1 and so its detailed description will be omitted. The heating blanket of the motorized wheelchair 100-2 is characterized in that a lower body of a user can easily be covered through the zipper part and the lower part thereof is a closed type.

Figure 16:
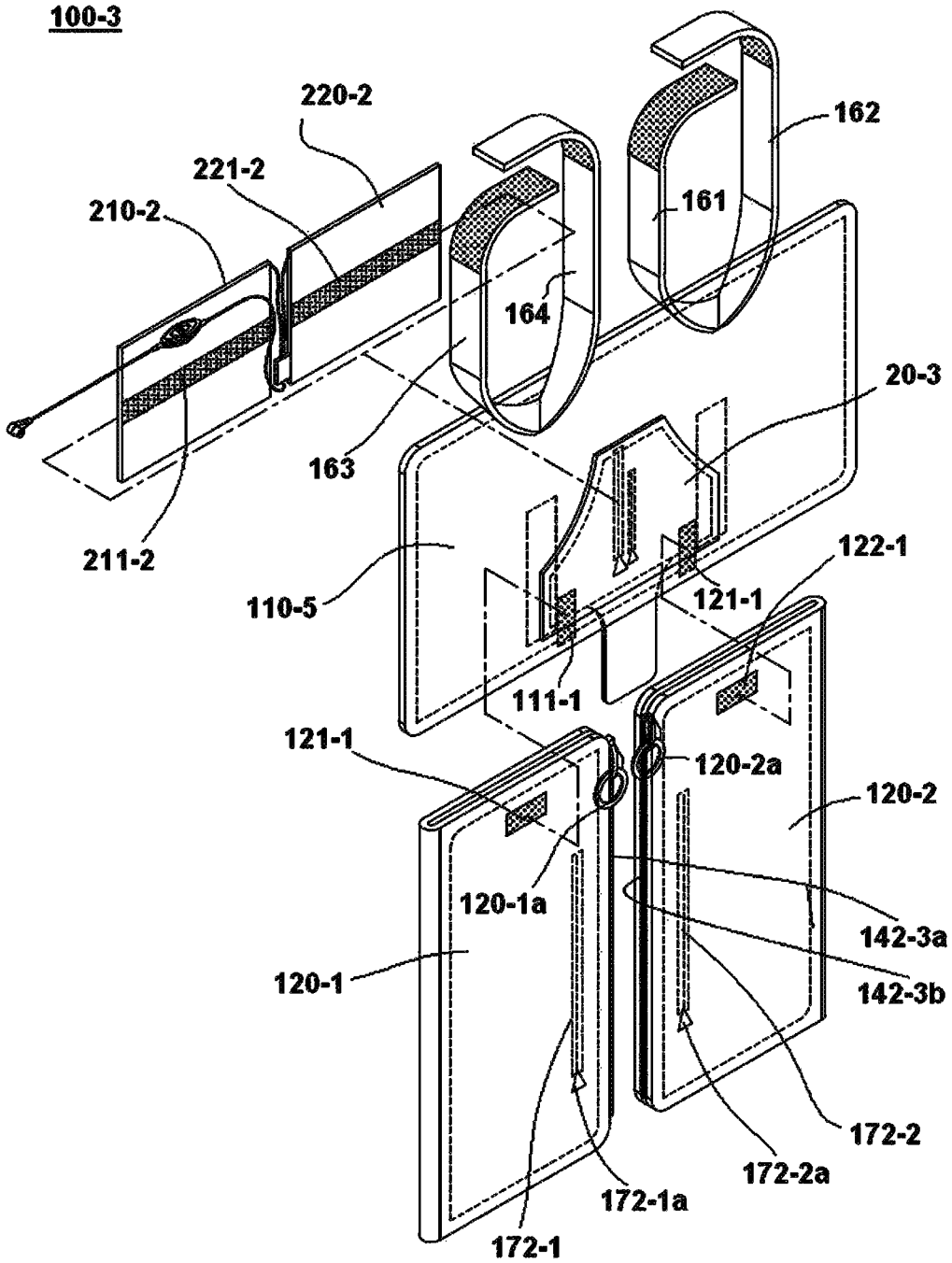
FIG. 16 is an exploded perspective view of another embodiment of a heating blanket for a motorized wheelchair according to the present invention.
Figure 17:
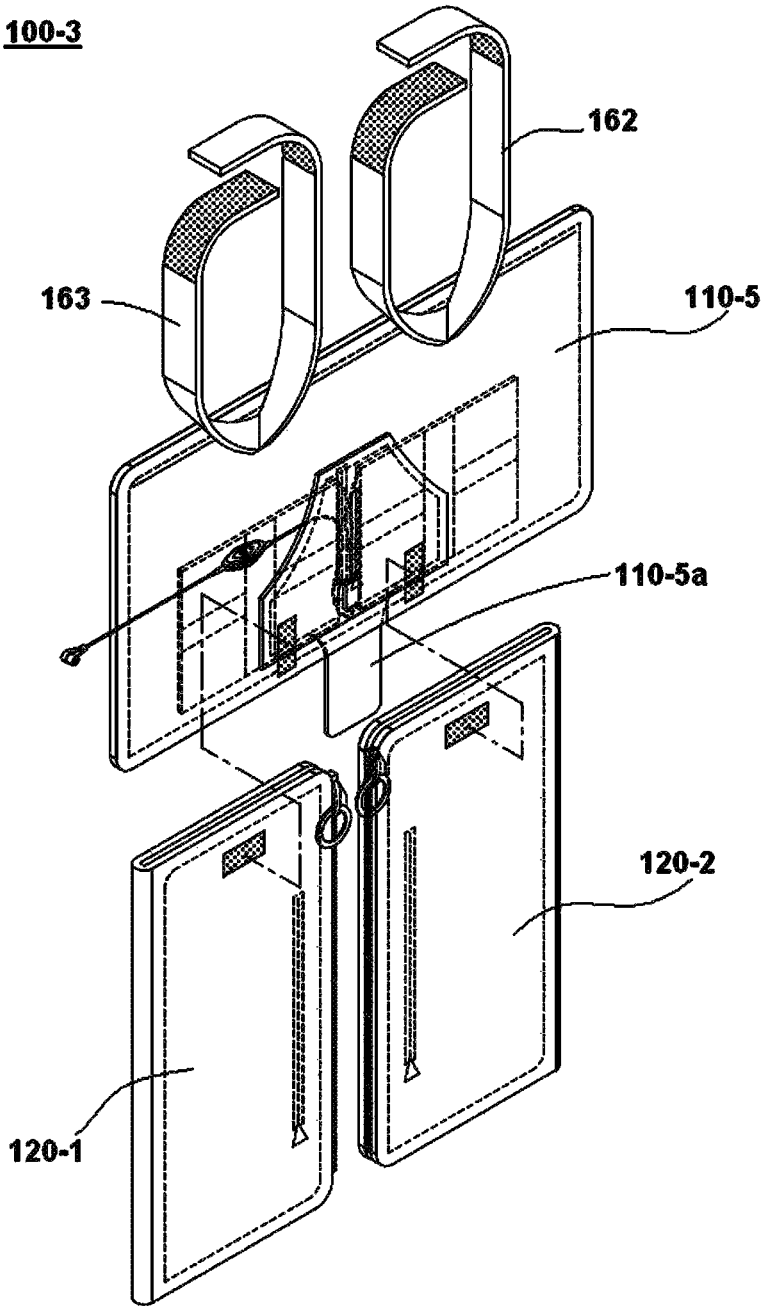
FIG. 17 is a combined perspective view of FIG. 16.
Figure 18:
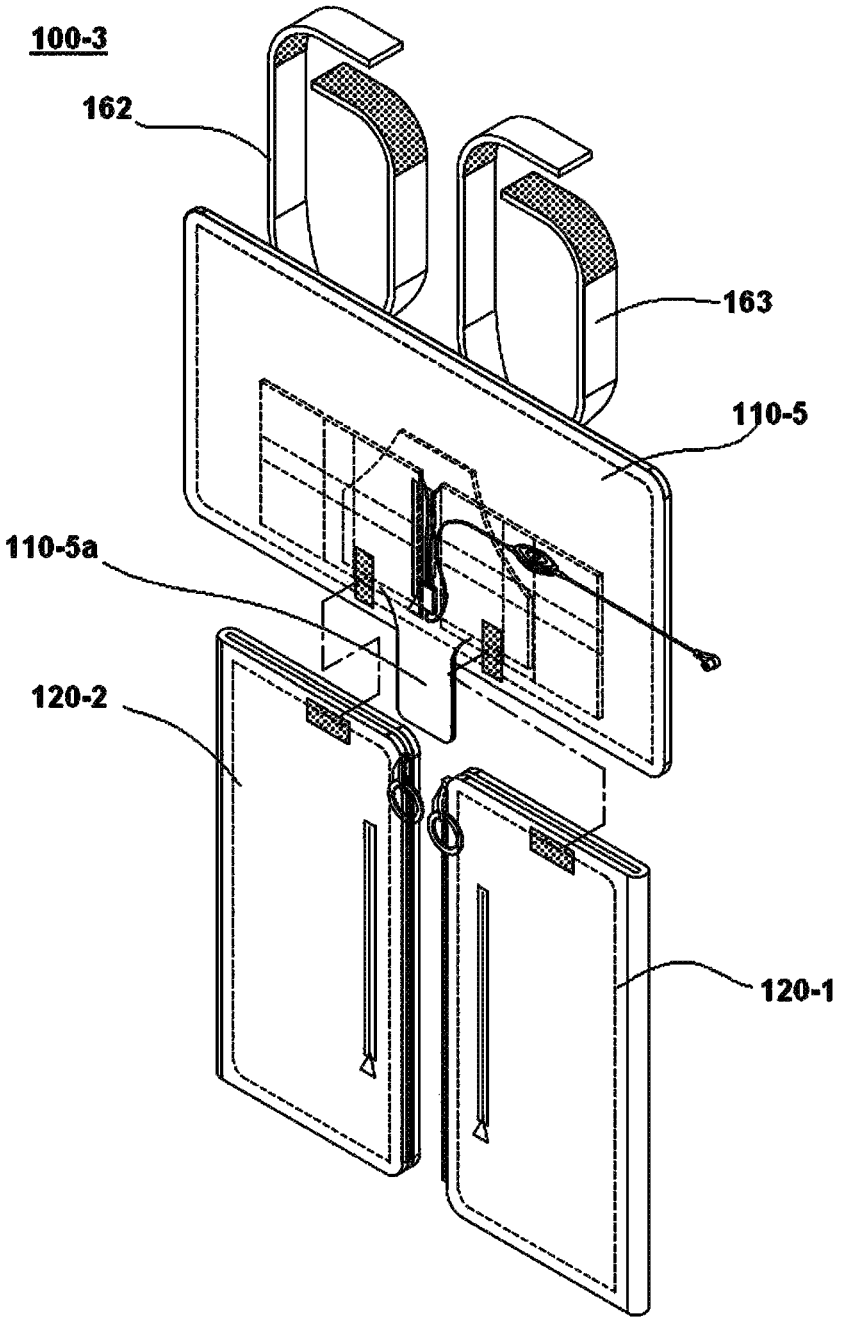
FIG. 18 is a perspective view of a back side of FIG. 16.
Figure 19:
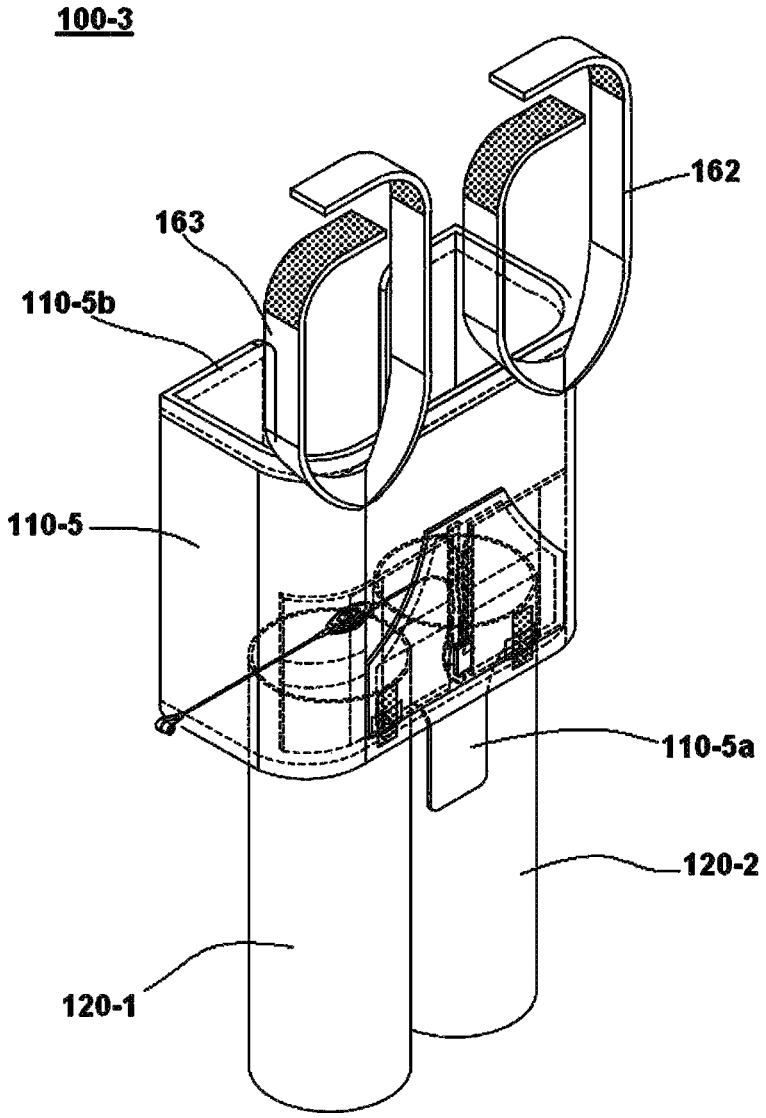
FIG. 19 is a perspective view of a use state of FIG. 16.

FIG. 16 is an exploded perspective view of another embodiment of a heating blanket for a motorized wheelchair according to the present invention. FIG. 17 is a combined perspective view of FIG. 16. FIG. 18 is a perspective view of a back side of FIG. 16. FIG. 19 is a perspective view of a use state of FIG. 16.

As shown in FIGS. 16 to 19, according to a heating blanket for a motorized wheelchair 100-3 comprises a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to the outside to allow the heating plate to be heated by receiving power from a power supply unit of the motorized wheelchair, wherein the front side of the windproof and waterproof fabric 110-5 is provided with an upper pocket part 20-3 which covers the zipped entrance/exit and of which both the upper side and the lower side, except for a hand entrance/exit slot, are sewn.

The electric wire and the connection part are positioned at the inside of the windproof and waterproof fabric together with the heating plates 211-2 and 220-2.

The connection jack is connected with a battery of the motorized wheelchair and located at the upper pocket part together with the battery. The controller also is located at the inside or outside of the upper pocket part, so that it can be easily operated at the inside or outside of the upper pocket part.

A protection part 110-5*a* is extended and formed at the lower middle end of the windproof and waterproof fabric.

A pair of lower body windproof and waterproof fabrics 120-1 and 120-2 cover a thermal lining having Velcro fasteners attached to at least one position thereof, has windproof and waterproof functions, and has a zipper and a zipped entrance/exit formed on the front and back sides thereof.

The lower body windproof and waterproof fabrics are characterized in that at least one heating plate which is inserted into a back side windproof and waterproof fabric via the zipper entrance/exits 172-1 and 172-2 and is detachably mounted on the thermal lining, wherein the heating plate is woven with carbon yarns so that the heating plate generates heat when electricity is applied.

The lower body windproof and waterproof fabrics are folded and then used. Zipper part 142-3*a* and 142-3*b* are formed at the parts corresponding to the folded parts and also the lower body windproof and waterproof fabrics are combined and separated by zippers 120-1*a* and 120-2*a*.

The lower body windproof and waterproof fabrics are combined with the wind proof and waterproof fabric by Velcro fasteners 121-1 and 122-1 and after combining, the protection part 110-5*a* of the windproof and waterproof fabric is positioned at the middle portion of the lower body windproof and waterproof fabrics.

A pair of left and right arm straps or shoulder hooking straps 161, 162, 163, and 164 are equipped with the upper side of the windproof and waterproof fabric 110-5.

An operation of the heating blanket of the motorized wheelchair 100-3 with the above-construction is the same as the embodiment of FIG. 1 and so its detailed description will be omitted. The heating blanket of the motorized wheelchair 100-3 is characterized in that a protection part is additionally provided and the lower body windproof and waterproof fabrics are separate types that lower parts are easily covered through zipper parts. Since the lower body windproof and waterproof fabrics are separates types, they can be easily used and kept.

The invention claimed is:

1. A heating blanket for a motorized wheelchair comprising: a windproof and waterproof fabric which covers a thermal lining having Velcro fasteners attached to at least one position thereof, has windproof and waterproof functions, and has a zipper and a zipped entrance/exit formed on front and back sides thereof; at least one heating plate which is inserted into a back side windproof and waterproof fabric via the zipper entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to an outside to allow the heating plate to be heated by receiving power from a power supply unit of the motorized wheelchair, wherein the front side of the windproof and waterproof fabric is provided with an upper pocket part which covers the zipped entrance/exit and of which both an upper side and a lower side, except for a hand entrance/exit slot, are sewn, wherein the electric wire and the connection part are positioned at an inside of the windproof and waterproof fabric together with the heating plate, wherein the connection jack is connected with a battery of the motorized wheelchair and located at the upper pocket part together with the battery, wherein a controller is located at an inside or outside of the upper pocket part, wherein the windproof and waterproof fabric comprises a front fabric having the upper pocket part, a bottom fabric connected with a partial lower part of the front fabric to form a bottom, and a back side fabric connected with the back side of the front fabric and the bottom fabric to form a space, and wherein zipper parts are formed at the lower side and a partial bottom side of the front fabric, a zipper part is formed at a side of the bottom fabric corresponding to the zipper part of the front fabric, and zipper parts are formed at a side of the back side fabric corresponding to the zipper part of the front fabric, so that the zipper parts are combined by a zipper part and a back side space is formed through the front fabric, the back side fabric, and the bottom fabric.

2. The heating blanket for a motorized wheelchair according to claim 1, wherein a pair of left and right arm straps or shoulder hooking straps are equipped with the upper side of the windproof and waterproof fabric.

3. A heating blanket for a motorized wheelchair comprising: a windproof and waterproof fabric which covers a thermal lining having Velcro fasteners attached to at least one position thereof, has windproof and waterproof functions, and has a zipper and a zipped entrance/exit formed on the front and back sides thereof; at least one heating plate which is inserted into a back side windproof and waterproof fabric via the zipper entrance/exit and is detachably mounted on the thermal lining, wherein the heating plate is woven with carbon yarns so that the heating plate generates heat when electricity is applied; an electric wire, a connection part, an adjustment part, and a connection jack for supplying electricity to the heat plate, wherein the heating blanket is characterized in that the connection jack is connected to an outside to allow the heating plate to be heated by receiving power from a power supply unit of the motorized wheelchair, wherein the front side of the windproof and waterproof fabric is provided with an upper pocket part which covers the zipped entrance/exit and of which both an upper side and a lower side, except for a hand entrance/exit slot, are sewn, wherein the electric wire and the connection part are positioned at an inside of the windproof and waterproof fabric together with the heating plate, wherein the connection jack is connected with a battery of the motorized wheelchair and located at the upper pocket part together with the battery, and a controller also is located at an inside or outside of the upper pocket part, wherein a protection part is extended and formed at the lower middle end of the windproof and waterproof fabric, wherein a pair of lower body windproof and waterproof fabrics cover a thermal lining having Velcro fasteners attached to at least one position thereof, has windproof and waterproof functions, and has a zipper and a zipped entrance/exit formed on the front and back sides thereof, wherein the lower body windproof and waterproof fabrics are characterized in that at least one heating plate which is inserted into a back side windproof and waterproof fabric via the zipper entrance/exits is detachably mounted on the thermal lining, wherein the heating plate is woven with carbon yarns so that the heating plate generates heat when electricity is applied, wherein the lower body windproof and waterproof fabrics are folded and then used, and zipper parts are formed at the parts corresponding to the folded parts and also the lower body windproof and waterproof fabrics are combined and separated by zippers, and wherein the lower body windproof and waterproof fabrics are combined with the wind proof and waterproof fabric by Velcro fasteners and after combining, the protection part of the windproof and waterproof fabric is positioned at the middle portion of the lower body windproof and waterproof fabrics.

4. The heating blanket for a motorized wheelchair according to claim 3, wherein a pair of left and right arm straps or shoulder hooking straps are equipped with the upper side of the windproof and waterproof fabric.

* * * * *